United States Patent [19]

Ishii et al.

[11] Patent Number: 4,496,451

[45] Date of Patent: Jan. 29, 1985

[54] ION EXCHANGE MEMBRANE MANUFACTURE FOR ELECTROLYTIC CELL

[75] Inventors: Tsuneji Ishii; Hiroaki Ito; Takamichi Ishikawa, all of Yokohama, Japan

[73] Assignee: Asahi Glass Company, Ltd., Tokyo, Japan

[21] Appl. No.: 377,016

[22] Filed: May 11, 1982

[30] Foreign Application Priority Data

May 22, 1981 [JP] Japan ..... 56-76751
May 22, 1981 [JP] Japan ..... 56-76752

[51] Int. Cl.[3] ..... C25B 9/00; C25B 11/03; C25B 13/08

[52] U.S. Cl. ..... 204/252; 204/283; 204/266; 204/296; 427/146; 156/230

[58] Field of Search ..... 204/252, 282–283, 204/263–266, 98, 128, 296; 427/146; 156/230

[56] References Cited

U.S. PATENT DOCUMENTS 4,124,458 11/1978 Moeglich ..... 204/98
4,224,121 9/1980 Dempsey et al. ..... 204/98
4,272,337 6/1981 Darlington ..... 204/98
4,297,182 10/1981 Oda et al. ..... 204/283 X
4,319,969 3/1982 Oda et al. ..... 204/296 X
4,339,314 7/1982 Hoekje ..... 204/252 X
4,361,601 11/1982 Hillman et al. ..... 204/296 X
4,364,803 12/1982 Nidola et al. ..... 204/283 X
4,364,813 12/1982 White ..... 204/252

*Primary Examiner*—Donald R. Valentine
*Attorney, Agent, or Firm*—Oblon, Fisher, Spivak, McClelland & Maier

[57] ABSTRACT

An ion exchange membrane electrolytic cell comprises an anode, a cathode, an anode compartment and a cathode compartment partitioned by an ion exchange membrane; an improvement characterized in that a gas and liquid permeable porous non-electrode layer is bonded to at least one of surfaces of said ion exchange membrane and said porous non-electrode layer is formed by coating electric non-conductive or conductive particles on the surface of a support to form a thin layer, transferring said thin layer onto the surface of said membrane and bonding said thin layer to said membrane by the application of heat and pressure.

17 Claims, No Drawings

ION EXCHANGE MEMBRANE MANUFACTURE FOR ELECTROLYTIC CELL

BACKGROUND OF THE INVENTION

1. Field of the Invention

The present invention relates to an ion exchange membrane electrolytic cell. More particularly, it relates to an ion exchange membrane electrolytic cell suitable for an electrolysis of water or an aqueous solution of an acid, a base, an alkali metal sulfate, an alkali metal carbonate, or an alkali metal halide.

2. Description of the Prior Art

As a process for producing an alkali metal hydroxide by an electrolysis of an aqueous solution of an alkali metal chloride, a diaphragm method has been mainly employed instead of a mercury method in view of a prevention of a public pollution.

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

On the other hand, it has been proposed to save energy in the world. From the viewpoint, it has been required to minimize a cell voltage in such technology.

It has been proposed to reduce a cell voltage by improvements in the materials, compositions and configurations of an anode and a cathode and compositions of an ion exchange membrane and a kind of ion exchange group.

It has been proposed to attain an electrolysis by a so-called solid polymer electrolyte type electrolysis of an alkali metal chloride wherein a cation exchange membrane of a fluorinated polymer is bonded with gas-liquid permeable catalytic anode on one surface and a gas-liquid permeable catalytic cathode on the other surface of the membrane (British Pat. No. 2,009,795, U.S. Pat. Nos. 4,210,501, 4,214,958 and 4,217,401).

This electrolytic method is remarkably advantageous as an electrolysis at a lower cell voltage because an electric resistance caused by an electrolyte and an electric resistance caused by bubbles of hydrogen gas and chlorine gas generated in the electrolysis, can be remarkably decreased which have been considered to be difficult to reduce in the conventional electrolysis.

The anode and the cathode in this electrolytic cell are bonded on the surface of the ion exchange membrane to be embedded partially. The gas and the electrolyte solution are readily permeated so as to easily remove, from the electrode, the gas formed by the electrolysis at the electrode layer contacting with the membrane. Such porous electrode is usually made of a thin porous layer which is formed by uniformly mixing particles which act as an anode or a cathode with a binder, further graphite or the other electric conductive material. However, it has been found that when an electrolytic cell having the electrode bonded directly to an ion exchange membrane is used, the anode in the electrolytic cell is brought into contact with hydroxyl ion which is reversely diffused from the cathode compartment, and accordingly, both of chlorine resistance and an alkaline resistance for anode material are required and an expensive material must be used. When the electrode layer is bonded to the ion exchange membrane, a gas is formed by the electrode reaction between an electrode and membrane and certain deformation phenomenon of the ion exchange membrane is caused to deteriorate the characteristics of the membrane. It is difficult to work for a long time in stable. In such electrolytic cell, the current collector for electric supply to the electrode layer bonded to the ion exchange membrane should closely contact with the electrode layer. When a firm contact is not obtained, the cell voltage may be increased. The cell structure for securely contacting the current collector with the electrode layer is disadvantageously complicated.

The inventors have studied to operate an electrolysis of an aqueous solution at a minimized load voltage and have found that the purpose has been satisfactorily attained by using a cation exchange membrane having a gas and liquid permeable porous non-electrode layer on at least one of surfaces of the cation exchange membrane facing to an anode or a cathode which is proposed in European Patent Publication No. 0029751 or U.S. Ser. No. 205,567.

The effect for reducing a cell voltage by the use of the cation exchange membrane having such porous layer on the surface is depending upon a kind of the material, a porosity and a thickness of the porous layer. Thus, it is surprising phenomenon that the effect for reducing a cell voltage is attained even by the use of the porous layer made of a non-conductive material. The effect for reducing a cell voltage is also attained even though electrodes are placed with a gap from the membrane without contacting the electrode to the membrane, although the extent of the effect is not remarkable.

The electrolytic cell of the invention in which such a porous non-electrode layer is used, is advantageous over a conventional electrolytic cell in which a porous electrode layer is used, in that not only a low cell voltage is thereby obtainable, but also the electrode material can be selected from a wide range of materials since the electrode is not directly in contact with the membrane, and it is thereby possible to avoid troubles due to the generation of gases at the interface between the membrane and the porous layer.

In the electrolytic cell in which such a porous non-electrode layer is used, the uniformity of the porous non-electrode layer and the secure bonding of the layer to the ion exchange membrane are important factors influential to the efficiency of the electrolytic cell. Namely, if the thickness of the porous layer is not uniform or the bonding of the porous layer to the membrane is inadequate, the porous layer tends to be peeled off partly, thus leading to an increase of the cell voltage, or gases or an excess amount of the electrolytic solution tends to be retained at the bonding interface, thus leading to an increase of the cell voltage, whereby the intended advantages tend to be reduced or hardly obtainable.

SUMMARY OF THE INVENTION

It is an object of the present invention to provide an electrolytic cell whereby the cell voltage can be minimized.

It is another object of the present invention to provide an electrolytic cell with a low and stable cell voltage for a long period.

Another object of the present invention is to provide an electrolytic cell in which an ion exchange membrane with a porous non-electrode layer of a uniform thickness securely bonded thereto is used.

The foregoing and other objects of the present invention have been attained by providing a new ion exchange membrane cell comprising an anode compartment, a cathode compartment formed by partitioning an anode and a cathode with an ion exchange membrane to which a gas and liquid permeable porous non-electrode layer is bonded and at least one of said anode and cathode is placed in contact or non-contact with said gas and liquid permeable porous non-electrode layer. The porous non-electrode layer is composed of a thin layer of electric non-conductive or conductive particles, and it can be formed on the surface of the ion exchange membrane in the following manner. Namely, said particles are coated on the surface of a support to form a thin layer, then the thin layer is transferred onto the surface of the ion exchange membrane, and the thin layer is bonded to the surface of the ion exchange membrane by the application of heat and pressure.

DETAILED DESCRIPTION OF THE PREFERRED EMBODIMENTS

The particles for the gas and liquid permeable porous layer formed on the cation exchange membrane can be conductive or non-conductive and can be made of an inorganic or organic material as far as the particles do not impart an electrode function. It is preferable to be made of a material having high corrosion resistance to an electrolyte and evolved gas at electrode, such as metals, oxides, hydroxides, carbides, nitrides of metals and mixtures thereof, and corrosion resistance polymers especially fluorinated polymers.

In the case of an electrolysis of an aqueous solution of an alkali metal chloride, the porous layer in the anode side can be made of a powder selected from the group consisting of metals in IV-A Group (preferably Ge, Sn, Pb); metals in IV-B Group (preferably Ti, Zr, Hf); metals in V-B Group (preferably Nb, Ta); metals in iron Group (Fe, Co, Ni) or alloys, oxides, hydroxides, nitrides and carbides thereof.

On the other hand, the porous layer in the cathode side can be a powder used for the porous layer in the anode side and also silver, stainless steel and carbon (active carbon, graphite etc.).

In the formation of the porous layer, the material is preferably used in a form of a powder having a particle diameter of 0.01–300$\mu$ especially 0.1–100$\mu$.

For satisfactory gas and liquid permeability, the porous non-electrode layer bonded to the surface of the ion exchange membrane should preferably have a porosity of 10 to 99%, more preferably 25 to 95%, and a thickness of 0.01 to 200$\mu$, more preferably 0.1 to 100$\mu$. An amount of the particles bonded is preferably in a range of 0.001–50 mg/cm$^2$, especially 0.01–30 mg/cm$^2$ based on the unit area of the surface of the membrane. If the amount of the particles is excessively small, the desired voltage-saving will not be obtained. On the other hand, if the amount is excessively large, it is likely that the cell voltage will thereby be increased.

According to the present invention, firstly the particles are coated on the surface of an appropriate support to form a thin layer. In this coating step, it is preferred to use a paste comprising the particles. Namely, it is preferred to use a paste composed of a mixture of the particles with water or an organic solvent such as an alcohol, ketone or hydrocarbon. In the paste, if necessary, it is possible to use a binder of a fluorocarbon polymer such as polytetrafluoroethylene and polytrifluorochloroethylene; or a thickener of a cellulose derivative such as carboxymethyl cellulose, methyl cellulose and hydroxyethyl cellulose; or a water soluble thickener such as polyethyleneglycol, polyvinyl alcohol, polyvinyl pyrrolidone, sodium polyacrylate, polymethyl vinyl ether, casein and polyacrylamide.

The binder or the thickener is preferably used at a ratio of 1 to 50 wt.% especially 0.5 to 30 wt.% based on the particles.

If necessary, an appropriate surfactant such as a long chain hydrocarbon or fluorinated hydrocarbon may further be added to facilitate the coating.

According to the present invention, the thin layer of the particles coated on the surface of the support is then transferred to the surface of an ion exchange membrane. A series of the operational steps of such coating and transferring can advantageously be carried out by a roll coating method with use of a roll as the support. Namely, the above-mentioned paste is continuously coated on the surface of a roll by a coater, and the coated layer of the paste is then continuously transferred to the surface of the ion exchange membrane by pressing it against the surface of the ion exchange membrane. As the coater to be used for this operation, there may be mentioned various coaters including a rod coater, a bar coater, a blade coater, a knife coater, an air-knife coater, a reverse roll coater, a gravure roll coater, a kiss coater, a calender coater, a nip coater, and a wire wound doctor coater.

As a preferred embodiment of the present invention, there may be mentioned a method in which e.g. a plastic film is used as the support, and the above-mentioned paste is coated on the surface of the film and then transferred onto the surface of the ion exchange membrane. As such a supporting film, there may be used any film or sheet selected from a wide range of materials so long as it has a flat surface and adequate heat resistance. For instance, there may be mentioned a plastic film made of a saturated polyester resin such as polyethylene terephthalate, a polyamide resin, a polycarbonate resin, a high density polyethylene resin, a polypropylene resin, a cellulose acetate resin, a polyimide resin, or a fluorine-containing resin. Taking into accounts the heating and pressing in the drying and transferring steps which will be described hereinafter, it is preferred to use a heat resistant plastic film made of e.g. a saturated polyester resin, a fluorinated resin such as polytetrafluoroethylene, a tetrafluoroethylene/hexafluoropropylene copolymer, an ethylene/tetrafluoroethylene copolymer, polyvinylidene fluoride, polyvinyl fluoride, an ethylene/trifluorochloroethylene copolymer or a tetrafluoroethylene/perfluorovinyl ether copolymer, or a polyimide resin. Such a plastic film may be a film treated by stretching such as biaxial stretching or an impregnated or laminated film combined with e.g. glass cloth. Further, a metal film such as an aluminum foil or a sheet of paper may be used as the supporting film.

The thickness of the supporting film may be selected usually within a range of 12 to 2000$\mu$, preferably 12 to 400$\mu$, more preferably 25 to 250$\mu$. Further, the supporting film may have a modified surface. For instance, the surface on which the paste layer is to be formed, may be embossed, roughened by sand blasts or treated with a releasing agent.

Various methods may be employed for coating the particles on the surface of the supporting film, such as spray coating, brush coating or screen printing. In order to continuously form the layer of the particles having a uniform thickness on a wide film, the above-mentioned roll coating is preferred in which a paste is used. In such a coating method, the concentration of the particles in the paste, etc. are controlled so that the particles are coated on the surface of the supporting film in an amount of 0.001 to 50 mg/cm$^2$ as mentioned above.

The amount of the particles coated on the surface of the ion exchange membrane or the support may be controlled by e.g. the solid content concentration in the paste, the viscosity of the paste, the transportation speed of the coated layer or the film or the rotational speed of each roll in the case of the roll coating method, or by e.g. a space between the back-up roll and the bar coater in the case of the bar coater method. In the case of the gravure roll coater, the coating amount of the particles may further be controlled by the pattern of the gravure roll. In any case, the paste is coated in an amount to bring the content of the particles to fall within a range of 0.001 to 50 mg/cm$^2$, preferably 0.01 to 30 mg/cm$^2$, and so as to form a layer of a predetermined thickness as uniform as possible.

The ion exchange membrane coated with a layer of the paste is transported to a heat-drying oven, and the volatile components in the paste are evaporated and removed. Thus, a porous layer composed of a thin layer of the particles is formed on the surface of the membrane. In a case of an elongated ion exchange membrane, it is possible to wind up the membrane after forming such a porous layer on one side of the membrane by the above method, and then to apply the same coating treatment to the other side so that the porous layer may be formed on both sides of the membrane.

The drying operation of the paste coated on the ion exchange membrane is conducted at a temperature within a range wherein the ion exchange membrane undergoes no thermal degradation, e.g. at a temperature of at most 320° C. The drying temperature and time are optionally selected depending upon the composition of the solvents in the paste, etc.

According to the present invention, the paste can directly be coated or transferred onto the surface of the ion exchange membrane and then dried to remove the volatile components such as water and the solvents, as mentioned above. However, in such a method, the water or the solvents in the paste coated on the membrane surface tend to penetrate into the membrane and it will then be required to apply a high temperature drying for the removal of the volatile components, thus leading to an operational disadvantage. Further, there will be certain difficulty in the control of the coating amount of the particles.

Therefore, according to a preferred embodiment of the present invention, the paste is coated on the surface of a support such as a plastic film and dried to form a dried porous layer having a predetermined amount of the particles on the surface of the support, and then the dried porous layer is transferred onto the ion exchange membrane. The transferred porous layer is then pressed under heating and securely bonded to the surface of the ion exchange membrane.

In forming the porous layer on the surface of the support such as a supporting film, it is preferred to use a paste as mentioned above. However, the particles may be coated on the surface of the support to form a thin layer, by means of e.g. an electrostatic powder coating method or a fluidized impregnation coating method.

The porous layer thus formed on the surface of the support is then transferred onto the surface of the ion exchange membrane and bonded thereto. Usually, such a support is placed on one side or both sides of the membrane so that the porous layer is brought in contact with the membrane surface, and heated and pressed to transfer the porous layer from the support surface to the ion exchange membrane surface, whereby the porous layer is partially embedded in the ion exchange membrane surface. As such a pressing method, there may be employed a flat plate pressing method in which the support and the membrane are pressed against each other between a pair of heated flat plates, or a roll pressing method in which the support and the membrane are continuously pressed between a pair of heated rolls, particularly between a metal roll and a rubber roll, which are rotated. The temperature for the pressing may be selected within a wide range of 100° to 300° C. at which the ion exchange membrane is softened or melt. The pressure is 1 to 1000 kg/cm$^2$, preferably 1 to 200 kg/cm$^2$ in the case of the flat plate pressing method, and 0.5 to 200 kg/cm of the roll length, preferably 1 to 100 kg/cm of the roll length, in the case of the roll pressing method.

In the present invention, the ion exchange membrane on which a porous layer is formed, is preferably a membrane of a fluorine-containing polymer having cation exchange groups. Such a membrane is preferably made of a copolymer of a vinyl monomer such as tetrafluoroethylene or chlorotrifluoroethylene with a fluorovinyl monomer containing ion exchange groups such as sulfonic acid groups, carboxylic acid groups and phosphoric acid groups.

The ion exchange membrane is preferably made of a fluorinated polymer having the following units $$\text{(M)}\quad \left(CF_2-CXX'\right) \quad \text{(M mole \%)}$$
$$\text{(N)}\quad \left(CF_2-\underset{\underset{Y-A}{|}}{CX}\right) \quad \text{(N mole \%)}$$

wherein X represents fluorine, chlorine or hydrogen or $-CF_3$; X' represents X or $CF_3(CH_2)_m$; m represents an integer of 1 to 5.

The typical examples of Y have the structures bonding A to a fluorocarbon group such as $$\left(CF_2\right)_x,\ -O\left(CF_2\right)_x,\ \left(O-CF_2-\underset{\underset{Z}{|}}{CF}\right)_y,$$

$$-CF_2\left(O-CF_2-\underset{\underset{Z}{|}}{CF}\right)_y,\ \left(O-CF_2-\underset{\underset{Z}{|}}{CF}\right)_x\left(O-CF_2-\underset{\underset{Rf}{|}}{CF}\right)_y \text{ and}$$

$$-O-CF_2\left(CF-O-\underset{\underset{Z}{|}}{CF_2}\right)_x\left(CF_2\right)_y\left(CF_2-O-\underset{\underset{Rf}{|}}{CF}\right)_z$$

x, y and z respectively represent an integer of 1 to 10; Z and Rf represent —F or a $C_1$–$C_{10}$ perfluoroalkyl group; and A represents —COOM or —$SO_3M$, or a functional group which is convertible into —COOM or —$SO_3M$ by a hydrolysis or a neutralization such as —CN, —COF, —$COOR_1$, —$SO_2F$ and —$CONR_2R_3$ or —$SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated ion exchange membrane having an ion exchange group content of 0.5 to 4.0 milliequivalent/gram dry polymer especially 0.8 to 2.0 milliequivalent/gram dry polymer which is made of said copolymer.

In the ion exchange membrane of a copolymer having the units (M) and (N), the ratio of the units (N) is preferably in a range of 1 to 40 mol % preferably 3 to 25 mol %.

The ion exchange membrane used in this invention is not limited to be made of only one kind of the polymer or the polymer having only one kind of the ion exchange group. It is possible to use a laminated membrane made of two kinds of the polymers having lower ion exchange capacity in the cathode side, or an exchange membrane having a weak acidic ion exchange group such as carboxylic acid group in the cathode side and a strong acidic ion exchange group such as sulfonic acid group in the anode side.

The ion exchange membranes used in the present invention can be fabricated by various conventional methods and they can preferably be reinforced by a fabric such as a woven fabric or a net, a non-woven fabric or a porous film made of a fluorinated polymer such as polytetrafluoroethylene or a net or perforated plate made of a metal.

The thickness of the membrane is preferably 50 to 1000 microns especially 50 to 400 microns, further especially 100 to 500$\mu$.

The porous non-electrode layer is formed on the anode side, the cathode side or both sides of the ion exchange membrane by bonding to the ion exchange membrane in a suitable manner which does not decompose ion exchange groups, preferably, in a form of an acid or ester in the case of carboxylic acid groups or in a form of $—SO_2F$ in the case of sulfonic acid group.

In the electrolytic cell of the present invention, various electrodes can be used, for example, foraminous electrodes having openings such as a porous plate, a screen a punched metal or an expanded metal are preferably used. The electrode having openings is preferably a punched metal with holes having a ratio of opening area of 30 to 90% or an expanded metal with openings of a major length of 1.0 to 10 mm and a minor length of 0.5 to 10 mm, a width of a mesh of 0.1 to 1.3 mm and a ratio of opening area of 30 to 90%.

A plurality of plate electrodes can be used in layers. In the case of a plurality of electrodes having different opening area being used in layers, the electrode having smaller opening area is placed close to the membrane.

The anode is usually made of a platinum group metal, a conductive platinum group metal oxide or a conductive reduced oxide thereof.

The cathode is usually a platinum group metal, a conductive platinum group metal oxide or an iron group metal.

The platinum group metal can be Pt, Rh, Ru, Pd or Ir. The iron group metal is iron, cobalt, nickel, Raney nickel, stabilized Raney nickel, stainless steel, a stainless steel treated by etching with a base (U.S. Pat. No. 4,255,247), Raney nickel plated cathode (U.S. Pat. Nos. 4,170,536 and 4,116,804), or nickel rhodanate plated cathode (U.S. Pat. Nos. 4,190,514 and 4,190,516).

When the electrode having openings is used, the electrode can be made of the materials for the anode or the cathode by itself. When the platinum metal or the condutive platinum metal oxide is used, it is preferable to coat such material on an expanded metal made of a valve metal, such as titanium or tantalum.

When the electrodes are placed in the electrolytic cell of the present invention, it is preferable to contact the electrode with the porous non-electrode layer so as to reduce the cell voltage. The electrode, however, can be placed leaving a proper space from the porous non-electrode layer. When the electrodes are placed in contact with the porous non-electrode layer, it is preferable to contact them under a low pressure e.g. 0 to 2.0 kg/cm$^2$, rather than high pressure.

When the porous non-electrode layer is formed on only one surface of the membrane, the electrode at the other side of the ion exchange membrane having no porous layer can be placed in contact with the membrane or with a space from the membrane.

The electrolytic cell used in the present invention can be monopolar or bipolar type in the above-mentioned structure. The electrolytic cell used for the electrolysis of an aqueous solution of an alkali metal chloride, is made of a material being resistant to the aqueous solution of the alkali metal chloride and chlorine such as valve metal like titanium in the anode compartment and is made of a material being resistant to an alkali metal hydroxide and hydrogen such as iron, stainless steel or nickel in the cathode compartment.

In the present invention, the process condition for the electrolysis of an aqueous solution of an alkali metal chloride can be the known condition as disclosed in the above-mentioned Japanese Laid-Open Patent Application No. 112398/79.

For example, an aqueous solution of an alkali metal chloride (2.5 to 5.0 Normal) is fed into the anode compartment, and water or a dilute solution of an alkali metal hydroxide is fed into the cathode compartment and the electrolysis is preferably carried out at 80° to 120° C. and at a current density of 10 to 100 A/dcm$^2$.

In this case, heavy metal ions such as calcium or magnesium ions in the aqueous alkali metal chloride solution tend to lead to degradation of the ion exchange membrane, and it is desirable to minimize such ions as far as possible. Further, in order to prevent the generation of oxygen at the anode, an acid such as hydrochloric acid may be added to the aqueous alkali metal solution.

Although the electrolytic cell for the electrolysis of an alkali metal chloride has been illustrated, the electrolytic cell of the present invention can likewise be used for the electrolysis of water, a halogen acid (HCl, HBr) an alkali metal carbonate, etc.

The present invention will be further illustrated by certain examples which are provided for purposes of illustration only and are not intended to limit the present invention.

EXAMPLE 1

To a solvent mixture prepared by uniformly mixing 600 g of water containing 11 g of methyl cellulose, 93 g of cyclohexanol and 31 g of cyclohexanone, there were added and mixed 260 g of titanium oxide particles having a particle size of at most 5$\mu$ and 26 g of polytetrafluoroethylene particles having a particle size of at most 1$\mu$ and coated on their surface with a copolymer of tetrafluoroethylene and $CF_2{=}CFO(CF_2)_3COOCH_3$ to obtain a suspension paste. The paste was coated on one side of a stretched saturated polyester film having a thickness of 100$\mu$ with use of a roll coater comprising a bar coater and a back-up roller. The space between the bar coater and the polyester film transported along the back-up roller was kept to be about 35$\mu$ and the coating was carried out at a speed of 3 m/min. The coated film was continuously dried in a drying oven having a length of 4 m and kept at a temperature of 110° C. to evaporate the solvents. The bonding strength of the coated layer formed on the polyester film was not so strong but sufficiently strong to be durable during the handling operations such as winding up and unwinding operations.

A pair of such polyester films each coated with a porous layer were arranged to face each other with the porous layers located inside and an ion exchange membrane was set between them, and they were continuously passed between a metal roll and a silicone-lined rubber roll having a diameter of 30 cm and heated at a temperature of 150° C. at a speed of 30 cm/min and thus roll-pressed. As the ion exchange membrane, a cation exchange membrane made of a copolymer of tetrafluoroethylene and $CF_2{=}CFO(CF_2)_3COOCH_3$ and having an ion exchange capacity of 1.43 milliequivalent/gram dry polymer and a thickness of 210μ was used. The roll pressure of the roll press was 40 kg/cm of the roll length. After the pressing, the polyester films were peeled off from the ion exchange membrane, whereby the coated layers were completely transferred to the respective sides of the ion exchange membrane and no coated layers remained on the surfaces of the polyester films.

The ion exchange membrane having on its both sides the porous layers formed by the transferring, was immersed and hydrolyzed in an aqueous solution containing 25% by weight of sodium hydroxide. The amount of titanium oxide bonded to each side of the ion exchange membrane was about 1 mg/cm$^2$.

Then, an anode having a low chlorine overvoltage and made of a titanium expanded metal (the minor length: 2.5 mm, the major length: 5 mm) coated with a solid solution of ruthenium oxide, iridium oxide and titanium oxide and a cathode prepared by subjecting a SUS-304 expanded metal (the minor length: 2.5 mm, the major length: 5.0 mm) to etching treatment in a 52% sodium hydroxide aqueous solution at 150° C. for 52 hours to have a low hydrogen overvoltage, were brought in contact with the anode side and the cathode side, respectively, of the ion exchange membrane under pressure of 0.01 kg/cm$^2$. Electrolysis was conducted at 90° C. under 40 A/dm$^2$ while supplying a 5N sodium chloride aqueous solution to the anode compartment and water to the cathode compartment and maintaining the sodium chloride concentration in the anode compartment at a level of 4N and the sodium hydroxide concentration in the cathode compartment at a level of 35% by weight. The following results were thereby obtained.

| Cell voltage (V) | Current efficiency (%) |
|---|---|
| 3.07 | 93.2 |

COMPARATIVE EXAMPLE 1

Electrolysis was conducted in the same manner as in Example 1 except that no porous layer was provided on either side of the ion exchange membrane as used in Example 1. The following results were thereby obtained.

| Cell voltage (V) | Current efficiency (%) |
|---|---|
| 3.41 | 93.8 |

EXAMPLE 2

To a solvent mixture prepared by uniformly mixing 650 g of water containing 13 g of methyl cellulose, 46 g of cyclohexanol and 15 g of cyclohexanone, there were added and mixed 290 g of zirconium oxide particles having an average particle size of 5μ, to obtain a suspension paste A.

On the other hand, to a solvent mixture prepared by uniformly mixing 730 g of water containing 13 g of methyl cellulose, 46 g of cyclohexanol and 15 g of cyclohexanone, there were added 220 g of SiC particles having an average particle size of 5μ, to obtain a suspension paste B.

The above paste A was coated on one side of an ion exchange membrane with use of a direct type gravure coater having a gravure roll having a lattice pattern of 95 mesh. Namely, the paste A was first coated on the surface of the gravure roll to form a thin layer, and the thin layer was then transferred onto the surface of the ion exchange membrane to form a thin layer of the paste A on the one side of the ion exchange membrane. The ion exchange membrane was the same cation exchange membrane as in Example 1. The coating speed was 3.5 m/min. The coated membrane was then continuously dried in a drying oven having a length of 4 m and kept at a temperature of 110° C. Then, on the other side of the ion exchange membrane, the above paste B was coated and dried under the same conditions as described above.

The ion exchange membrane having the porous layers formed on both sides thereof was sandwiched between a pair of stretched saturated polyester films having a thickness of 100μ and pressed between a metal roll and a silicone rubber lined roll having a diameter of 30 cm and heated at a temperature of 150° C. at a speed of 30 cm/min under pressure of 40 kg/cm of the roll length and continuously wound up.

The pair of polyester films used as protective films were peeled off, whereupon an ion exchange membrane having the porous layers securely bonded to the respective sides of the ion exchange membrane was obtained. The membrane thus obtained was immersed in an aqueous solution containing 25% by weight of sodium hydroxide to hydrolyze the membrane. The ion exchange membrane thus obtained had 0.5 mg/cm$^2$ of zirconium oxide particles bonded on one side and 0.5 mg/cm$^2$ of SiC particles bonded on the other side.

Then, an anode having a low chlorine overvoltage and made of a titanium expanded metal (the minor length: 2.5 mm, the major length: 5 mm) coated with a solid solution of ruthenium oxide, iridium oxide and titanium oxide and a cathode prepared by subjecting a SUS-304 expanded metal (the minor length: 2.5 mm, the major length: 5.0 mm) to etching treatment in a 52% sodium hydroxide aqueous solution at 150° C. for 52 hours to have a low hydrogen overvoltage, were brought in contact with the zirconium oxide layer side and the SiC layer side, respectively, of the ion exchange membrane under pressure of 0.01 kg/cm$^2$. Electrolysis was conducted at 90° C. under 40 A/dm$^2$ while supplying a 5N sodium chloride aqueous solution to the anode compartment and water to the cathode compartment and maintaining the sodium chloride concentration in the anode compartment at a level of 4N and the sodium hydroxide concentration in the cathode compartment at a level of 35% by weight. The following results were thereby obtained.

| Cell voltage (V) | Current efficiency (%) |
|---|---|
| 3.07 | 93.2 |

EXAMPLE 3

The paste A in Example 2 was coated on one side of a stretched saturated polyeser film having a thickness of 100μ by means of a roll coater comprising a bar coater and a back-up roller. The coating was conducted with a space between the bar coater and the polyester film transported along the back-up roller being kept at a level of about 35μ and at a speed of 3 m/min. The coated film was then continuously dried in a drying oven having a length of 4 m and kept at 110° C. to evaporate the solvents in the paste, whereupon a porous layer composed of zirconium oxide particles was formed on the polyester film.

On the other hand, a porous layer composed of SiC particles was formed on a separate polyester film in the same manner as above, except that the paste B in Example 2 was used.

As the ion exchange membrane, there was used a laminated membrane comprising a cation exchange membrane (high AR membrane) made of a copolymer of $C_2F_4$ and $CF_2{=}CFO(CF_2)_3COOCH_3$ and having an ion exchange capacity of 1.48 milliequivalent/gram dry polymer and a thickness of 250μ and a cation exchange membrane (low AR membrane) made of a copolymer of $C_2F_4$ and $CF_2{=}CFO(CF_2)_3COOCH_3$ and having an ion exchange capacity of 1.30 milliequivalent/gram dry polymer and a thickness of 25μ.

A pair of the above polyester films having the porous layers thereon were arranged to face each other with the porous layers located inside and the above laminated ion exchange membrane was set between them, and they were pressed under heating by means of a flat plate pressing machine. The arrangement was such that the SiC porous layer was located on the low AR membrane side of the laminated membrane and the zirconium oxide porous layer was located on the high AR membrane side. The heat pressing was carried out at 140° C. for 6 minutes followed by gradual cooling to room temperature in 10 minutes. During the heat pressing, the pressure was kept at a level of 30 kg/cm$^2$. After the heat pressing, the polyester films were peeled off from the ion exchange membrane, whereby almost all the porous layers were transferred to the respective sides of the ion exchange membrane and no porous layers remained on the surfaces of the polyester films.

The ion exchange membrane having on its both sides the porous layers formed by the transferring, were immersed and hydrolyzed in an aqueous solution containing 25% by weight of sodium hydroxide. The amounts of zirconium oxide and SiC bonded to the respective sides of the ion exchange membrane were 1.2 mg/cm$^2$ and 0.8 mg/cm$^2$, respectively.

Then, an anode having a low chlorine overvoltage and made of an titanium expanded metal (the minor length: 2.5 mm, the major length: 5 mm) coated with a solid solution of ruthenium oxide, iridium oxide and titanium oxide and a cathode prepared by subjecting a SUS-304 expanded metal (the minor length: 2.5 mm, the major length: 5.0 mm) to etching treatment in a 52% sodium hydroxide aqueous solution at 150° C. for 52 hours to have a low hydrogen overvoltage, were brought in contact with the zirconium oxide layer side and the SiC layer side, respectively, of the ion exchange membrane under pressure of 0.01 kg/cm$^2$. Electrolysis was conducted at 90° C. under 40 A/dm$^2$ while supplying a 5N sodium chloride aqueous solution to the anode compartment and water to the cathode compartment and maintaining the sodium chloride concentration in the anode compartment at a level of 4N and the sodium hydroxide concentration in the cathode compartment at a level of 35% by weight. The following results were thereby obtained.

| Cell voltage (V) | Current efficiency (%) |
|---|---|
| 3.20 | 94.0 |

COMPARATIVE EXAMPLE 2

Electrolysis was conducted in the same manner as in Example 3 except that no porous layer was provided on either side of the ion exchange membrane used in Example 3. The following results were thereby obtained.

| Cell voltage (V) | Current efficiency (%) |
|---|---|
| 3.60 | 95.0 |

We claim:

1. A method of manufacturing an ion exchange membrane for use in an electrolytic cell comprising an anode, a cathode, an anode compartment, a cathode compartment, and a gas and liquid permeable porous non-electrode layer bonded to at least one surface of said ion exchange member, which comprises:

coating electric non-conductive or conductive particles on the surface of a support to form a thin layer, drying the thin layer on the support, transferring said dried thin layer onto said surface of said membrane, and bonding said thin layer to said membrane by the application of heat and pressure.

2. The method of claim 1 wherein the gas and liquid permeable porous non-electrode layer has a porosity of 10 to 99% and a thickness of 0.01 to 200μ.

3. The method of claim 1 or 2 wherein the electric non-conductive or conductive particles are bonded to the surface of the membrane in an amount of 0.001 to 50 mg/cm$^2$.

4. The method of claim 1, or 2 wherein the electric non-conductive or conductive particles are made of an inorganic or organic material having corrosion resistance to an electrolyte and an evolved gas at an electrode.

5. The method of claim 1 wherein said support is a film.

6. The method of claim 1 wherein said support is a roll.

7. The method according to claim 1, 5 or 6 wherein the electric non-conductive or conductive particles are coated on the surface of the support in the form of a paste.

8. The method of claim 1 wherein the electric non-conductive or conductive particles are bonded to the surface of the membrane with a binder composed of a fluorinated polymer.

9. The method of claim 8 wherein the fluorinated polymer is a tetrafluoroethylene polymer.

10. The method of claim 1 wherein the electric non-conductive or conductive particles are made of a metal in IV-A Group, IV-B Group, V-B Group, ion Group or chromium, manganese or boron or an alloy, an oxide, a hydroxide, nitride or a carbide of said metal.

11. The method of claim 1 wherein said membrane has cation exchange groups selected from the group consisting of sulfonic acid groups, carboxylic acid groups and phosphoric groups.

12. The method of claim 1 wherein said membrane has an ion exchange capacity of 0.5 to 4.0 meq/g-dry polymer.

13. The method of claim 1 wherein said membrane is made of a perfluorocarbon polymer.

14. The method of claim 1 wherein said coating consists of coating a paste comprising electric non-conductive or conductive particles on a supporting film to form a thin layer and drying the paste.

15. The method of claim 1 wherein said membrane is made of a perfluro carbon polymer which has the following units (M) and (N):

$$\text{(M)}\quad \left(CS_2-CXX'\right)$$

$$\text{(N)}\quad \left(CF_2-\underset{\underset{Y-A}{|}}{CX}\right)$$

wherein X represents a fluorine, chlorine or hydrogen atom or $-CF_3$; X' represents X or $CF_3-(CH_2)m$ wherein m represents an integer from 1 to 5; Y is selected from the group consisting of $$\left(CF_2\right)_x,\ -O\left(CF_2\right)_x,\ \left(O-CF_2-\underset{\underset{Z}{|}}{CF}\right)_y,$$

$$-CF_2\left(O-CF_2-\underset{\underset{Z}{|}}{CF}\right)_y,\ \left(O-CF_2-\underset{\underset{Z}{|}}{CF}\right)_x\left(O-CF_2-\underset{\underset{Rf}{|}}{CF}\right)_y \text{ and}$$

$$-O-CF_2\left(\underset{\underset{Z}{|}}{CF}-O-CF_2\right)_x\left(CF_2\right)_y\left(CF_2-O-\underset{\underset{Rf}{|}}{CF}\right)_z$$

wherein x, y and z independently represent an integer from 1 to 10 and Z and Rf independently represent —F or a $C_1$–$C_{10}$ perfluoro alkyl group; and A represents —COOM or $-SO_3M$ or a functional group which is convertible into —COOM or $-SO_3M$ by a hydrolysis or a neutralization reaction wherein M represents hydrogen or an alkali metal atom.

16. The method of claim 15 wherein said functional group which is convertible into —COOM or $-SO_3M$ is —CN, —COF, $-COOR_1$, $-SO_2F$, $-CONR_2R_3$ or $-SO_2NR_2R_3$ independently wherein $R_1$ represents a $C_1$–$C_{10}$ alkyl group and $R_2$ and $R_3$ represent H or a $C_1$–$C_{10}$ alkyl group.

17. A method of manufacturing an ion exchange membrane for use in an electrolytic cell comprising an anode, a cathode, an anode compartment, a cathode compartment, and a gas and liquid permeable porous non-electrode layer bonded to at least one surface of said ion exchange member, which comprises:

coating a paste comprising electric non-conductive or conductive particles onto a supporting film to form a thin layer, drying the thin layer on the support, transferring said dried thin layer onto said surface of said membrane, and bonding said thin layer to said membrane by the application of heat and pressure.

* * * * *